United States Patent [19]

Scholten et al.

[11] 4,256,082

[45] Mar. 17, 1981

[54] WARM AIR FURNACE

[75] Inventors: Dale A. Scholten; Frederick J. Schreiner, both of Holland; Raymond J. Kenjesky, Muskegon; Kenneth E. Bartlett, Holland, all of Mich.

[73] Assignee: Lear Siegler, Inc., Holland, Mich.

[21] Appl. No.: 42,094

[22] Filed: May 24, 1979

[51] Int. Cl.[3] ..... F24H 3/02; F23M 9/00; F24D 5/00

[52] U.S. Cl. ..... 126/110 AA; 110/323; 126/99 A; 126/99 D; 126/109; 165/172; 165/177; 237/53

[58] Field of Search ..... 126/99 D, 110 AA, 99 A, 126/110 R, 116 R, 109, 103; 165/172, 177; 237/53; 110/322, 323, 324, 325

[56] References Cited

U.S. PATENT DOCUMENTS

| | | | |
|---|---|---|---|
| 171,888 | 1/1876 | Vose | 126/99 D |
| 192,835 | 7/1877 | Marchand | 126/99 D |
| 1,668,125 | 5/1928 | Regan | 126/99 D |
| 2,075,433 | 3/1937 | Eisentrager | 126/99 D |
| 2,094,456 | 9/1937 | Lattner | 126/99 D |
| 2,792,826 | 5/1957 | Kilbury | 126/110 AA |
| 3,223,078 | 12/1965 | Miller et al. | 126/110 AA |
| 3,266,480 | 8/1966 | Miller et al. | 126/110 AA |
| 3,656,470 | 4/1972 | Goodgion et al. | 126/110 AA |
| 3,902,473 | 9/1975 | Yeagle | 126/110 AA |
| 3,955,552 | 5/1976 | Weisenthal | 126/110 AA |

*Primary Examiner*—James C. Yeung
*Assistant Examiner*—Daniel O'Connor
*Attorney, Agent, or Firm*—Price, Heneveld, Huizenga & Cooper

[57] ABSTRACT

A warm air furnace including a plenum, a blower, heat exchanger disposed within the plenum and an air distribution chamber. The heat exchanger includes an encasement surrounding a plurality of vertically extending heat exchanger tubes. The tubes are in communication with the plenum and with the air distribution chamber. A fibrous refractory inorganic tubular flame chamber is positioned within the encasement and is partially surrounded by the vertically extending tubes. The tubes are positioned in a generally U-shaped pattern and one of the tubes contacts the flame chamber. The tubes along the sides of the pattern are interconnected by upper and lower side baffles. The baffles are vertically spaced from each other to define exhaust outlets. A rear baffle extends between the tubes along the base of the pattern. A flue extends from the encasement for exhaust of combustion gases.

11 Claims, 7 Drawing Figures

WARM AIR FURNACE

BACKGROUND OF THE INVENTION

The present invention relates to warm air furnaces and more particularly to down flow forced air furnaces primarily adapted for mobile home use.

In the heating of mobile homes and other structures where little space is available for the furnace, special problems are experienced. The furnace is typically positioned in a closet-like space where the exterior casing is close to paneling or other wall structures. The radiant heat from the furnace must be controlled or limited to prevent damage to the structure. Also, efficiency of operation is more critical than in other applications.

Typical down draft forced air furnaces include an exterior casing, a plenum and a heat exchanger positioned within the plenum. The exterior casing includes a louvered room air return opening and defines with the plenum an air receiving chamber or blower compartment. A blower is mounted in the chamber and forces air into the plenum and through the heat exchanger. A hot air distribution chamber is defined below the heat exchanger and receives heat air therefrom. The heated air is then directed to distribution ducts.

Examples of prior warm air furnaces adapted for mobile home use may be found in U.S. Pat. No. 3,223,078, entitled WARM AIR FURNACE and issued on Dec. 14, 1965, to Miller et al; U.S. Pat. No. 3,601,116, entitled MOBILE HOME FURNACE WITH AIR CIRCULATOR OUTLET MEANS and issued on Aug. 24, 1971, to Davis; U.S. Pat. No. 3,656,470, entitled BASE ASSEMBLY FOR MOBILE HOME FURNACE AND ISSUED ON Apr. 18, 1972, to Goodgion et al and U.S. Pat. No. 3,614,949, entitled MOBILE HOME FURNACE WITH MAKE UP AIR SUPPLY MEANS and issued on Oct. 26, 1971, to Goodgion.

The furnace disclosed in U.S. Pat. No. 3,223,078 includes an exterior casing in the upper portion of which is disposed a squirrel cage blower. A plenum chamber receives air from the blower and all of the air forced into the plenum chamber passes downwardly through a plurality of heat exchanger tubes. The heat exchanger tubes are in flow communication with an air distribution chamber. The tubes are concentrically arranged around a flame chamber defined by a baffle mantle. The tubes are positioned in spaced adjacent relationship with respect to each other in a generally rectangular fashion or in a generally circular fashion. The baffle mantle is formed from an inorganic fibrous insulating material which glows upon application of heat and prevents flame contact with the heat exchanger tubes. A flame gun is supported by the heat exchanger and injects flame into the baffle mantle or flame chamber. Baffle plates extend downwardly from the top of the tubes to points spaced above the lower ends of the tubes. The baffles join adjacent pairs of the tubes. Further, the heat exchanger tubes are in supporting contact with the flame chamber. A flue extension passes upwardly from the heat exchanger at the forward end thereof and through the air receiving chamber between a louvered air intake and the blower motor. The furnace may be either gas or oil fired. The flame chamber has a constricted open top and serves as a volumetric choke. A plurality of volumetric chokes or constrictions are defined by the structure resulting in positive pressure conditions in the combustion chamber.

The combustion gases pass out of the furnace in a generally S-shaped flow pattern.

SUMMARY OF THE INVENTION

In accordance with the present invention, a unique, efficient, easily manufactured and compact warm air furnace is provided. Essentially, the warm air furnace includes an exterior casing defining a louvered warm air return intake, an air receiving chamber within which a blower is mounted, a plenum in flow communication with the air receiving chamber and a distribution chamber defined by the exterior casing and a bottom panel. A heat exchanger is disposed within the plenum. The heat exchanger includes a wrapper or encasement dimensioned smaller than the plenum including a top panel and a plurality of vertically extending heat exchanger tubes which extend from the top panel to the bottom panel and are in communication with the plenum and the air distribution chamber. Air forced into the plenum passes downwardly through the heat exchanger tubes and also around the exterior of the encasement.

The top panel has a forward, downwardly angled surface and a fibrous inorganic flame chamber is supported on the bottom panel within the encasement. The heat exchanger tubes are arranged in spaced, adjacent relationship and surround only a portion of the flame chamber. The heat exchanger tubes along the side of the flame chamber are connected by vertically extending, spaced upper and lower side baffles. The heat exchanger tubes along the rear of the flame chamber are joined by a rear baffle extending from the top of the tubes downwardly to a point spaced from the bottom panel. The side baffles due to their vertically spaced relationship between adjacent tubes define vertically spaced combustion gas outlets. The flame chamber has a horizontal flange extending only partially around the open top thereof to define a partial constriction.

A flue extension extends upwardly from the rear of the encasement to a flue extending to the exterior casing. Positioning of the flue extension assists in preventing over heating of the blower motor since the amount of preheat of the room air is reduced.

DETAILED DESCRIPTION OF THE PREFERRED EMBODIMENT

Figure 1:
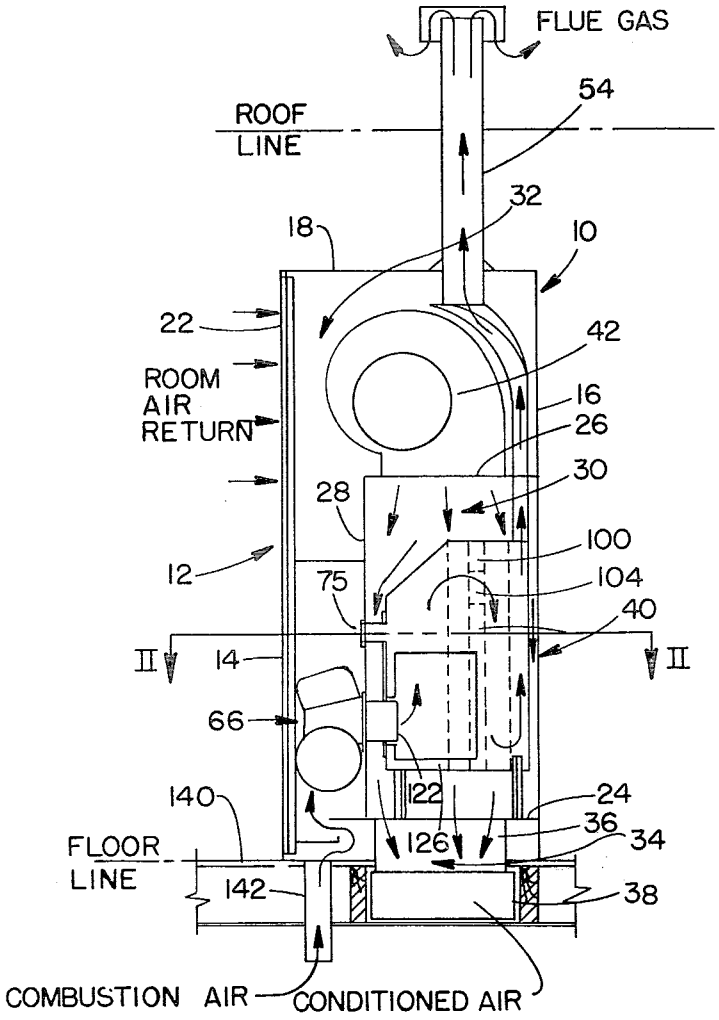
FIG. 1 is a side elevational view in section of a warm air furnace in accordance with the present invention.

The preferred embodiment of a warm air furnace in accordance with the present invention is illustrated in FIG. 1 and generally designated 10. The furnace includes an exterior casing 12 having a front panel 14, a rear panel 16, a top panel 18 and side panels 20. The front panel 14 at the upper portion thereof includes a louvered opening 22 which defines a room air return intake. Positioned within the exterior casing 12 is a floor panel 24 and plenum defining panels or plates 26, 28. Plate 26 extends towards the front 14 of the exterior casing from the rear wall 16 and panel 28 extends vertically from the forward edge of panel 26 to the bottom panel 24. Panels 24, 26 and 28 in conjunction with the sides and rear of the exterior casing define a plenum chamber generally designated 30. The exterior casing and panel 26 also define an air receiving chamber or blower motor compartment 32. The lower panel 24 opens into an air distribution chamber 34 defined by a duct structure 36. The air distribution chamber 34 is in communication with a distribution duct 38. The distribution duct is preferably positioned in the floor structure of the mobile home.

Positioned within the plenum 30 is a heat exchanger generally designated 40. A blower 42 is mounted in the compartment 32 on top of the plate 26. The blower 42 is in communication with the plenum 30 and forces room air downwardly into the plenum, around and through the heat exchanger 40.

Figure 2:
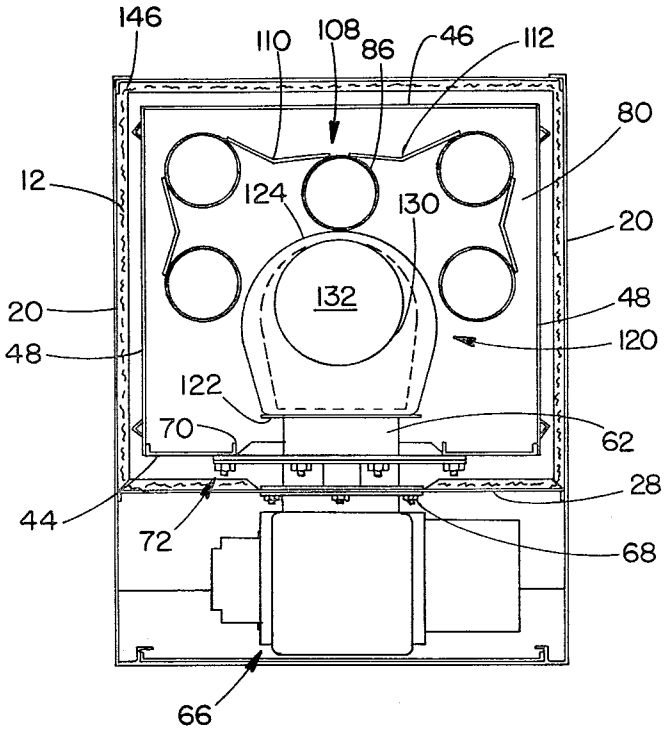
FIG. 2 is a cross sectional view taken generally along line II—II of FIG. 1.
Figures 3, 4, 6:
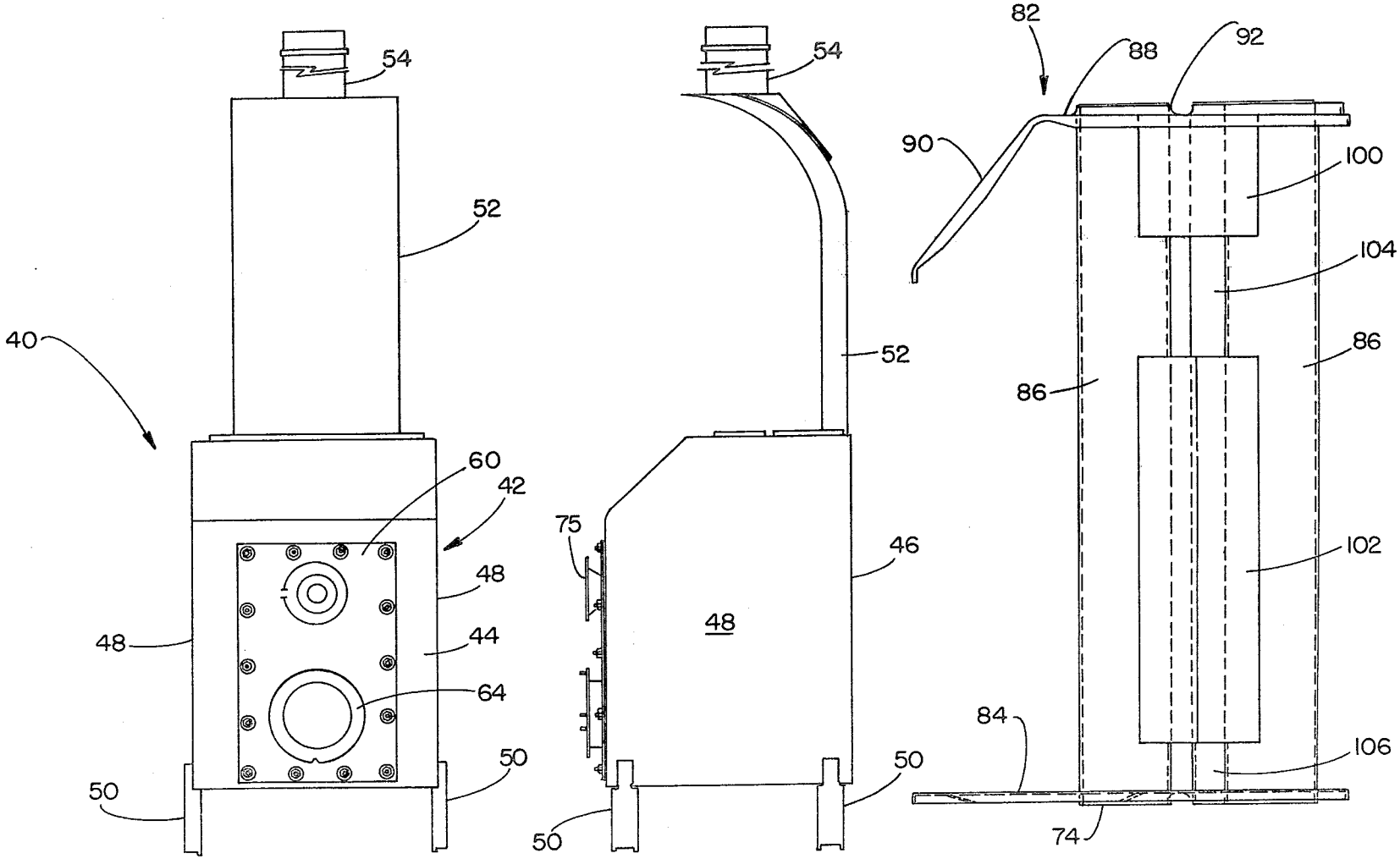
FIG. 3 is a front, elevational view of the heat exchanger in accordance with the present invention.
FIG. 4 is a side elevational view of the heat exchanger.
FIG. 6 is a side, elevational view of the heat exchanger tube unit.

As best seen in FIGS. 2, 3 and 4, the heat exchanger 40 includes an encasement or wrapper 42 having a front wall 44, a rear wall 46 and side walls 48. Legs 50 are secured to the encasement and support the heat exchanger 40 on the bottom wall or panel 24. A generally rectangular flue extension 52 extends upwardly from the rear of the wrapper 42. As seen in FIG. 1, flue extension 52 is configured to conform with the external shape of the blower 42 and is generally rectangular in section. Flue extension 52 is connected at its upper end to a flue pipe or chimney 54. In a conventional fashion, flue pipe 54 extends through the roof line (FIG. 1) and exhausts flue or combustion gases exteriorly of the mobile home or other building within which the furnace 10 is disposed.

Mounted on the front wall 44 of the encasement is a burner mounting plate 60. Plate 60 supports a burner tube 62 and has a flanged end 64 at which a flame gun 66 is mounted. The flame gun 66 may be secured to the tube 62 by bolts and nuts 68. The mounting plate 60 is secured in an aperture 70 (FIG. 2) in the front wall 44 by suitable bolts 72. Plate 60 also supports an observation point defining tube 75 (FIGS. 1 and 4).

Figure 7:
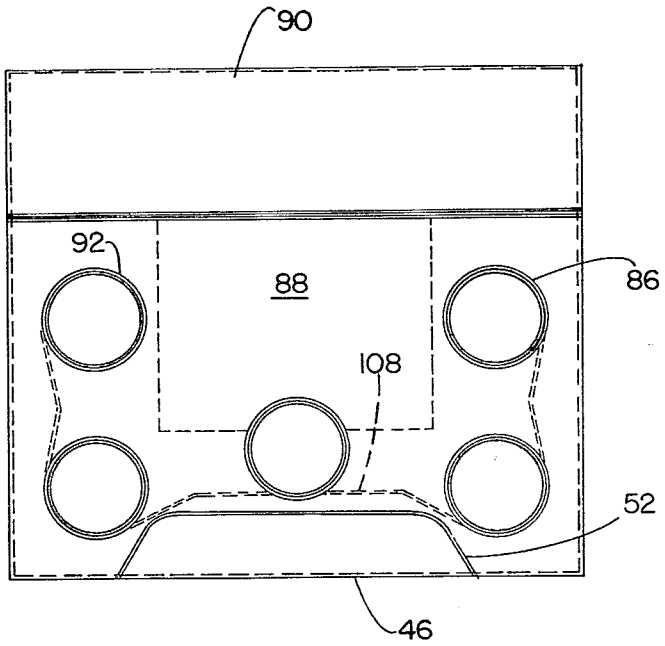
FIG. 7 is a top, plan view of the heat exchanger tube unit.
Figure 5:
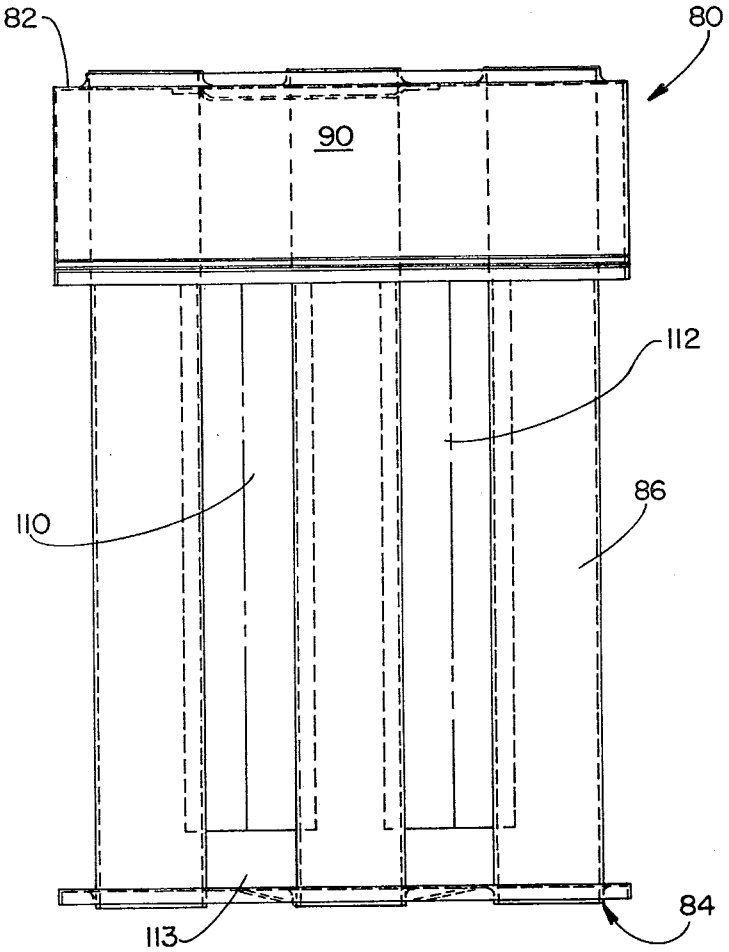
FIG. 5 is a front, elevational view of the heat exchanger tube unit employed in the present invention.

A heat exchanger tube unit 80 is positioned within the encasement or wrapper 40. As seen in FIGS. 5, 6 and 7, the heat exchanger tube unit 80 includes a top panel 82, a lower panel 84 and a plurality of heat exchanger tubes 86. Top panel 82 has a generally horizontal portion 88 and an angled downwardly sloped front portion 90. Formed in the horizontal portion 88 are a plurality of holes 92. As seen in FIG. 7, the holes are arranged in a generally U-shaped portion. Bottom panel 84 includes a plurality of similar holes 94 which are positioned in superimposed, co-axial relationship with the holes 92. The heat exchanger tubes 86 extend between the holes 92, 94 formed in the top panel 82 and bottom panel 84, respectively. As seen in FIGS. 3 and 4, the encasement sidewalls 48, front wall 44 and rear wall 46 are joined to the top panel 82 and the bottom panel 84. The encasement and the tube unit 80 form a sealed assembly.

As best seen in FIGS. 2, 5 and 6, adjacent pairs of tubes 86 along the sides or legs of the U-shaped pattern of tubes are joined by an upper short baffle 100 and a lower side baffle 102. Upper side baffle 100 extends from the top of the tubes at plate 82. Lower side baffle 102 extends from a point spaced vertically downwardly from the upper baffle 100 and terminates at a point spaced above the lower panel 84. The side baffles 100, 102 therefore define along with the tubes 86 a combustion gas outlet aperture or opening 104. The lower baffle 102 in conjunction with the plate 84 defines another vertically spaced exhaust opening 106. The baffles 100, 102 are preferably welded to the respective heat exchanger tubes 86. Baffles 100, 102 are generally V-shaped in horizontal section (FIG. 2).

Extending along the base of the U-shaped pattern is a rear baffle structure 108. The rear baffle structure 108 may be a single piece member or, as illustrated in FIG. 2, may include individual V-shaped baffle pieces 110, 112. The rear baffle extends from the top of the tubes 86 along the base downwardly to a point spaced above the lower plate 84. This is best seen in FIG. 5. The rear baffle defines another exhaust outlet 113. The vertical distance between the plate 84 and the lower ends of the rear baffles 110, 112 is equal to the vertical spacing between the plate 84 and the lower end of each baffle 102.

As best seen in FIGS. 1 and 2, a fibrous refractory inorganic tubular flame chamber or baffle mantle 120 is positioned on the bottom panel 84. Mantle 120 is partially surrounded by heat exchanger tubes 86. Flame chamber 120 includes a front wall 122 having an aperture formed therein in communication with the flame tube 62. As a result, flame from gun 66 is directed into the chamber 120 and impinges on a rear wall 124 of the chamber. In the preferred construction, a tube 86 along the base of the pattern is placed in contact with the flame chamber 120 at rear wall 124 directly opposite the flame inlet aperture 122.

As seen in FIG. 1, the flame chamber 120 may have an integral bottom 126 or it may have an open bottom and rest on a suitable refractory pad. The flame chamber 120 includes an upper end which is open and surrounded by a horizontal inwardly directed flange 130. Flange 130 extends around the chamber except at the area adjacent the rear wall 124 at the point of contact with the one exchanger tube 86. The flange 130 defines a circular outlet opening 132. The flame chamber 120 therefore defines a constricted orifice. As best seen in FIGS. 4 and 7, the flue extension 52 communicates with a space within the wrapper 40 defined by the rear baffle 108 and the rear wall 46 of the encasement.

As seen in FIG. 1, when the furnace 10 is installed in a mobile home or the like structure the casing 12 rests on the floor structure 140. The distribution chamber 34 is placed in communication with hot air distribution ducts 38. Further, a combustion air inlet tube 142 preferably extends through the floor structure 140 and communicates the interior of casing 12 at the flame gun 66 with outside air for combustion purposes.

During operation of the furnace, flame from gun 66 impinges against the rear wall 124 of the flame chamber 120. Due to the material from which the chamber is fabricated, the chamber or baffle mantle will glow with a chemiluminosity transferring heat in the form of radiant energy to the surfaces of the heat exchanger tubes and baffles. The combustion gases will flow upwardly through the constricted opening 132, contact the surfaces of the tubes facing the flame chamber and contacting the top panel 82. Due to the forward slope portion 90 of the top panel and the inclusion of the baffles 100, 102 and the rear baffle 108, the combustion gases will be urged across the top panel and downwardly again passing by the tubes. A portion of the combustion gases will pass through the openings 104 and along the sides of baffles exteriorly of the flame chamber. The encasement will direct these exhaust gases to the flue extension 52. The remaining portions of combustion gases may be passed around the tubes 86 at the front or forward edges of the U-shaped pattern around the back surfaces of the baffles and the inner surfaces of the walls of the encasement. Portions of the gas will also pass downwardly and pass through the constricted openings 106 and 113 defined by the baffles. Only these gases follow a generally S-shaped pattern. The gases pass upwardly through the space defined by the baffle structure 108 and rear wall 46 and to the flue extension 52.

Air drawn into the furnace by blower 42 is forced downwardly into the plenum chamber 30. Some of the air will pass vertically downwardly through the heat exchanger tubes 86 and then directly into the air distribution chamber 34. Air will also pass over, down and around the encasement 42 and top panel 82. This air will be heated when coming into contact with these portions of the furnace. The heat exchanger, as shown, is dimensioned smaller than the internal dimensions of the plenum.

Complete combustion of the gases occurs within the flame chamber 120. Since the flame does not directly impinge on any of the heat exchanger tubes or heat exchanger metal surfaces, the life of these components is significantly increased. The baffles serve to direct the combustion gases and retain them within the encasement or heat exchanger 40 for a longer period of time while not causing over heating of the furnace structure. Only a single tube 86 is in support contact with mantle 120 and then at the part where the flame contacts the mantle. Since the flue extension 52 extends upwardly rearwardly of the blower motor 42, excessive preheating of the room return air which could possibly cause damage to the blower motor is avoided. Overheating of the exterior casing is avoided. The efficiency of the furnace permits the components to be fabricated from conventional sheet steel. It is presently preferred that the flame chamber 120 be fabricated from a refractory material of the type set forth in U.S. Pat. No. 3,100,734 to John P. Rex, Jr., et al. The material is sold by Rex-Roto under the trademark PYROLITE No. 61 or is available from Johns Manville under the trademark CERAFORM.

The furnace in accordance with the present invention is compact, relatively easily and inexpensively manufactured employing conventional materials. The efficiency of the furnace prevents excessive heating of the outer casing 12 thereby avoiding possible damage to surrounding wall structure. As seen in FIG. 2, it is, however, presently preferred that a liner of insulating material 146 be secured to the inner surfaces of the casing 12 at least around the area of the plenum 30 and the heat exchanger 40. The furnace in accordance with the present invention may be either gas or oil fired employing conventional, readily available flame guns. The unique configuration of the heat exchanger 40 controls the flow of the combustion gases and insures an efficient and effective transfer of heat from these gases to the room air.

In view of the foregoing description, those of ordinary skill in the art will undoubtedly envision various modifications to the present invention which would not depart from the inventive concepts disclosed herein. It is therefore expressly intended that the above description should be considered as that of the preferred embodiment. The true spirit and scope of the present invention may be determined by reference to the appended claims.

The embodiments of the invention in which an exclusive property or privilege is claimed are defined as follows:

1. A forced air furnace of the type including an exterior casing having a room air return intake, an air receiving chamber, a plenum in flow communication with the air receiving chamber, a distribution chamber, a blower positioned in the receiving chamber for forcing air into the plenum chamber, and heat exchanger means disposed within the plenum for heating air forced into the plenum, the heat exchanger means comprising:

an encasement having a front wall, side walls, a rear wall, a bottom panel and a top panel, said front wall including means for supporting a flame gun and said encasement being dimensioned smaller than said plenum;

a plurality of vertical heat exchanger tubes extending from said bottom panel to said top panel, each of said tubes being in flow communication with the plenum chamber at one end and with the distribution chamber at the other end through openings defined by said top and bottom panels;

a fibrous refractory inorganic tubular flame chamber supported on said bottom panel, said heat exchanger tubes being positioned along only a portion of the sides of the flame chamber and along the rear of said flame chamber with one of said tubes being in supporting contact with said flame chamber;

upper short side baffles extending between adjacent pairs of tubes positioned along the sides of the flame chamber and extending from the top panel downwardly;

lower side baffles extending between the same adjacent pairs of tubes as said upper short side baffles and below and in spaced vertical relationship with said upper short side baffles so that said baffles define side exhaust openings between said adjacent pairs of tubes, which openings are positioned above the bottom panel and below the top panel of the encasement, said lower side baffles terminating at points spaced from said bottom panel to define additional exhaust openings adjacent the bottom panel of the encasement;

a rear baffle means extending between adjacent tubes across the rear of said flame chamber for closing off the space between said tubes, said rear baffle means extending from said top panel to a point spaced from said bottom panel so as to define further exhaust openings adjacent the bottom panel of the encasement; and flue means extending from said top panel for directing exhaust gases from said encasement exteriorly of said exterior casing.

2. A forced air furnace as defined by claim 1 wherein said flame chamber includes a front wall defining an access opening for the flame gun and a rear wall opposite the access opening, said one tube being the only tube contacting said flame chamber, said one tube contacting the flame chamber at said rear wall of said flame chamber and the remaining tubes being spaced from said flame chamber.

3. A forced air furnace as defined by claim 2 wherein said tubes are arranged in a generally U-shaped pattern around a portion of said flame chamber and said top panel of the encasement includes a downwardly angled portion.

4. A forced air furnace as defined by claim 3 wherein said flame chamber includes an upper exhaust gas outlet and a horizontal flange extending around only a portion of said upper exhaust gas outlet to define a constriction.

5. A forced air furnace as defined by claim 4 wherein said flue means comprises:

a generally rectangular in section extension tube extending from said top panel and in flow communication with a space defined by the rear wall of said encasement and said rear baffle means.

6. A heat exchanger for use in a forced air furnace, comprising:

a top panel having a plurality of holes therein arranged in a generally U-shaped pattern with the base of the U being spaced from and generally parallel to a rear edge of the top panel;

a bottom panel positioned in vertically spaced superimposed relationship with said top panel having a plurality of holes in alignment with the holes of the top panel;

a wrapper extending around the periphery of each of said top panel and said bottom panel and joining said top panel to said bottom panel, said wrapper including means for supporting a flame gun;

a plurality of heat exchanger tubes extending between the holes of said top panel and said bottom panel;

a flame chamber having an open top and a flame gun access opening, said flame chamber resting on said bottom panel and being partially surrounded by said tubes with only one of said tubes contacting the rear of said flame chamber;

upper side baffles between adjacent pairs of tubes and extending downwardly from said top panel;

lower side baffles between said adjacent pairs of tubes between which said upper side baffles extend and further extending downwardly in spaced relationship with said upper side baffles to define exhaust gas outlet openings positioned closer to the top panel than to the bottom panel;

a rear baffle between said tubes at the base of the U pattern, said rear baffle extending from the top panel to a point spaced above said bottom panel to define additional exhaust gas outlet openings adjacent said bottom panel; and a flue extending from an opening in said top panel whereby combustion gases will pass upwardly to contact the top panel, around the tubes, through the exhaust outlet openings, between the side baffles, below the rear baffle and out the flue.

7. A heat exchanger as defined by claim 6 wherein said upper side baffles and said lower side baffles are generally V-shaped in horizontal cross section.

8. A heat exchanger as defined by claim 6 wherein said flame chamber further includes a horizontal flange extending only partially around the open top to define a partial constriction.

9. A heat exchanger as defined by claim 8 wherein said flue communicates with a space defined by the rear baffle and said wrapper.

10. A heat exchanger as defined by claim 9 wherein five heat exchanger tubes are arranged partially around said flame chamber with four of the tubes being spaced from said heat exchanger and one of said tubes only contacting said flame chamber at a point opposite the flame gun access opening.

11. A heat exchanger as defined by claim 9 wherein said top panel includes a downwardly angled forward portion and a horizontal portion, said holes being formed in the horizontal portion.

* * * * *